United States Patent [19]

Hettich

[11] 4,373,905

[45] Feb. 15, 1983

[54] OIL HEATER

[76] Inventor: Allen J. Hettich, 4800 W. Richmond Rd., Aberdeen, S. Dak. 57401

[21] Appl. No.: 175,124

[22] Filed: Aug. 4, 1980

[51] Int. Cl.[3] ..... F23D 7/00

[52] U.S. Cl. ..... 431/330; 431/242; 431/247; 126/93

[58] Field of Search ..... 431/260, 330, 331-342, 431/213, 214, 242, 243, 247, 351; 126/93, 116 A, 112; 110/238

[56] References Cited

U.S. PATENT DOCUMENTS

| | | | |
|---|---|---|---|
| 1,512,869 | 10/1924 | Valjean | 431/330 |
| 2,316,226 | 4/1943 | Donley | 431/213 |
| 2,346,781 | 4/1944 | Perry | 431/213 |
| 2,614,618 | 10/1952 | Chadwick et al. | 431/337 |
| 4,303,055 | 12/1981 | Fixler | 126/93 |
| 4,308,854 | 1/1982 | Kroll | 126/93 |

FOREIGN PATENT DOCUMENTS

| | | | |
|---|---|---|---|
| 592917 | 2/1960 | Canada | 431/339 |
| 836675 | 1/1939 | France | 431/330 |
| 7713627 | 6/1979 | Netherlands | 431/213 |

*Primary Examiner*—Samuel Scott
*Assistant Examiner*—Lee E. Barrett
*Attorney, Agent, or Firm*—Malcolm Reid

[57] ABSTRACT

Oil heater for burning of waste oil or other like petroleum liquids through vaporization of the fuel resulting in total fuel burn and maximum BTU. Combustion air enters the center of a combustion chamber enclosure through a combustion air wand resulting in air flow in all directions. The wand includes a plurality of spaced holes in a closed annular air channel allowing for escape of air to the combustion chamber and a diffuser plate circumferentially affixed to the wand including a plurality of spaced holes in the diffuser plate for spreading and mixing resultant vapors and gases for burning at the level of the wand. A submerged pump in a fuel storage tank provides for even fuel flow to a center point above the air wand in addition to even air flow by a blower. A vaporizer pan in the bottom of the chamber provides for boiling of the fuel with its resulting vaporization and total burn of residue and ash.

9 Claims, 4 Drawing Figures

OIL HEATER

BACKGROUND OF THE INVENTION

1. Field of the Invention

The present invention relates to an oil heater and, more particularly, pertains to a waste oil heater for burning of waste oil from vehicles.

2. Description of the Prior Art

It has been a prior art practice to dispose of waste oil through deposit at a waste oil collection station, in the garbage can, or down the drain of the sewer system. While waste oil has never been used as a fuel in the past, recent escalation of fuel oil prices has changed this type of practice.

Prior art oil furnaces have never been manufactured to burn waste oil. Prior art furnaces have only been intended to burn clean fuel oil so as to avoid clogging of the fuel oil pump or the oil burners. Waste oil from vehicles, farm machinery, and other sources provides an endless supply of free or very inexpensive source of fuel which cannot be burned in prior art oil furnaces.

Prior art oil furnaces introduce air from channels around the outer walls of the combustion chamber to the center of the prior art furnaces not only decreasing efficiency, but also making clean-out of the bottom of the oil furnace nearly impossible. The present invention introduces combustion air from the center of the combustion chamber providing for air flow in all directions and providing for easy clean-out.

The present invention overcomes the disadvantages of the prior art in providing a combustion chamber including a combustion air wand having a plurality of spaced holes in a closed annular channel and including a diffuser plate circumferentially affixed to the air wand and having a plurality of spaced holes in the diffuser plate which surrounds the air wand for total burn of oil and resultant gases by spreading and mixing those gases. The burn or flame level surrounds the combustion air wand and is at the combustion air wand level.

There are numerous prior art U.S. Pat. Nos.: 768,798; 773,488; 781,331; 1,100,889; 1,042,650; 1,247,761; 709,370; 1,283,915; 1,350,199; 1,447,631; 1,710,703; 1,889,843; and 1,948,662 discussing the above prior art. None of the prior art patents show or disclose the present invention.

SUMMARY OF THE INVENTION

The general purpose of the present invention is to provide a waste oil heater for burning of waste oil and for deriving maximum heat output by transfer of combustion air to the center of the burn area, and by the diffusing of gases with combustion air for total burn.

According to one embodiment of the present invention, there is provided a waste oil heater for burning used petroleum oil, including a storage tank having a filler opening, a heat deflector supported on top of the tank, a combustion chamber supported on the heat deflector and supporting a spaced meshed safety screen, a combustion air wand supported in the center of the combustion chamber and including a small and large number of holes vertically spaced from each other about a closed annular air channel for providing combustion air, a diffuser plate circumferentially surrounding the air wand including a plurality of horizontally spaced holes, the diffuser plate being affixed between the small and the large number of holes in the annular channel for mixing air with vaporized oil forming a resultant vapor which burns, a pipe supporting the air wand-diffuser and connected between the closed annular channel, through the combustion chamber and to a blower supported outside of the combustion chamber for supplying preheated combustion air, an oil input tube having one end positioned through the combustion chamber above center of the air wand and the other end connected to a submersible pump in the storage tank, a vaporizer pan supported slightly above the heat deflector in the combustion chamber, a cam-locked access door in the lower front portion of the combustion chamber providing access to the vaporizer pan, a vent hole in the upper rear portion of the combustion chamber, a removable top cover in the top of the combustion chamber, and an electrical wall thermostat connected between the pump and blower and a power source whereby the oil pump drops oil above the center of the air wand which has a stream of moving air flowing through the plurality of holes in its annular channel after being preheated in the pipe by the surrounding flame area, and a vaporizer pan providing for initial combustion and subsequent boiling of excess fuel thereby generating maximum BTU from said petroleum.

A significant aspect and feature of the present invention is a waste oil heater which burns used petroleum oil or waste oil from transmission fluid to 90W automotive oil. No special adjustments are required for burning different weight oil other than initial set-up of the waste oil heater.

Another significant aspect and feature of the present invention is a combustion air wand where air flows in all directions in the center of the combustion chamber thereby supporting combustion in an area in the combustion chamber surrounding the air wand.

A further significant aspect and feature of the present invention is a waste oil heater having an oil injection tube above the combustion or flame area thereby avoiding plugging of burnt oil in the oil injection tube. The oil tube provides droplets of oil to the center of the air wand.

Having thus described the present invention, it is a principal objective hereof to provide an oil furnace or oil heater for burning waste oil.

Another objective is to provide a waste oil heater providing for quick and easy cleaning, and little or no servicing. This includes a submersible oil pump and an oil injection tube positioned above the flame area.

A further objective of the present invention is a large effective radiation area and large fuel oil storage tank of heavy-duty construction. The waste oil heater is constructed of heavy gauge steel or other metal welded together for long life under constant use thereby requiring little maintenance.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and wherein.

DESCRIPTION OF PREFERRED EMBODIMENTS

Figure 1:
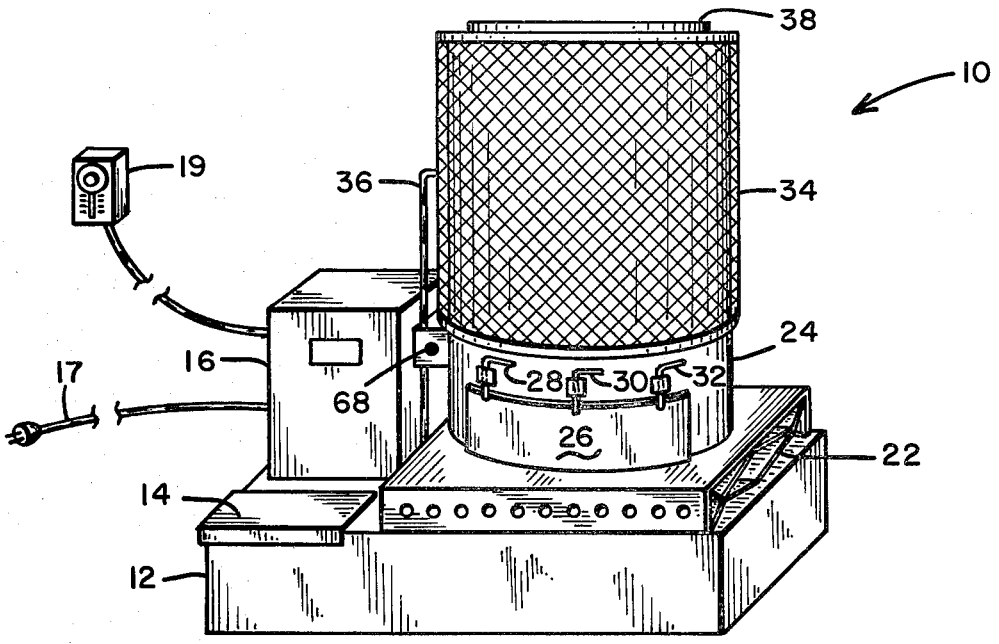
FIG. 1 illustrates a front plan view of a waste oil heater, the present invention.
Figure 2:
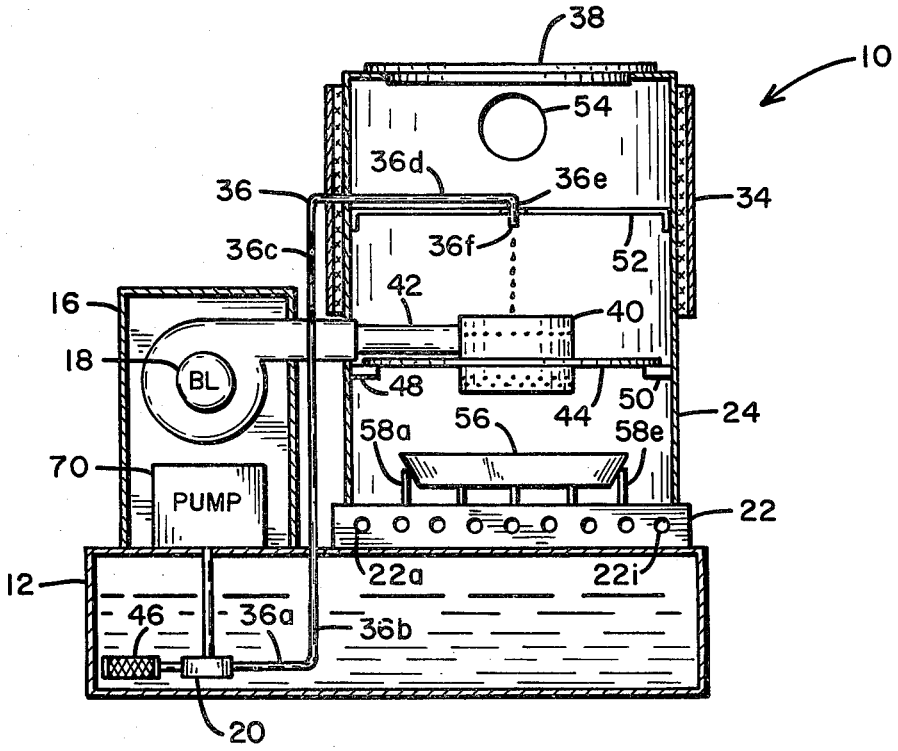
FIG. 2 illustrates a cutaway side view of the waste oil heater.
Figure 3:
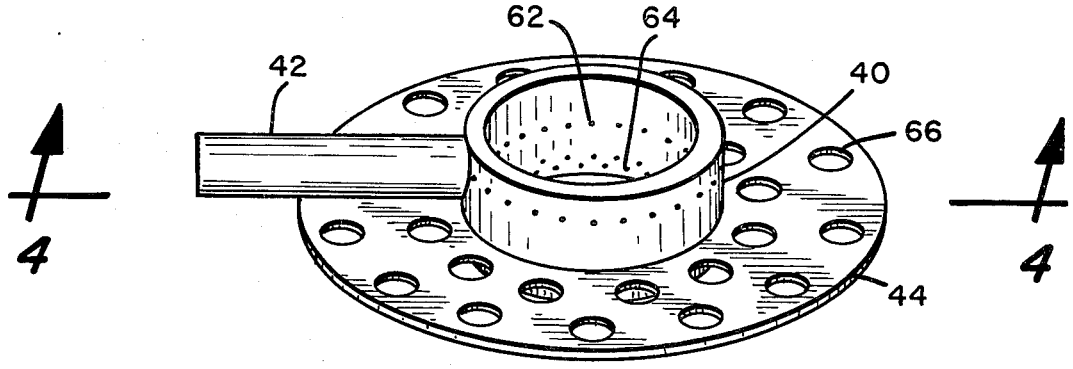
FIG. 3 illustrates an enlarged perspective view of the combustion air wand; and, FIG. 4 illustrates a sectional view taken along line 4—4 of FIG. 3.
Figure 4:
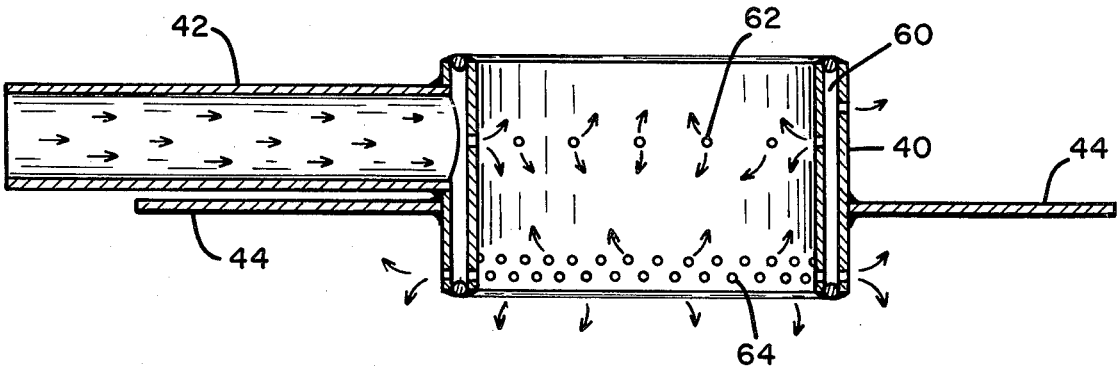

FIG. 1, which illustrates a front plan view of the present invention, shows a waste oil heater 10 including a contained oil storage tank 12, a filler opening 14, an electrical control box 16 including a power cord 17 and other components, a combustion air flow blower 18, a wall thermostat 19, and an oil pump 20 as illustrated in FIG. 2 and electrically connected together with the other components as known in the art, a heat deflector 22, a combustion chamber enclosure 24 including a clean-out opening 26 secured by cam-lock keys 28–32, a wire mesh screen heat protector 34 surrounding the chamber 24, an oil input tube or pipe 36 from the pump 20 into the chamber 24, a top member 38 over the chamber 24, and a combustion air wand 40 including a pipe 42 and a diffuser plate 44 as illustrated in FIGS. 2–4, where all elements are now described in detail. Venting pipe not illustrated in FIG. 1 connects to the rear of the chamber 24.

FIG. 2 illustrates a cutaway side view of FIG. 1 where all numerals correspond to those elements previously described. The pump 20 which is submersible in the tank 12 pumps waste oil from the storage tank 12 through a filter screen 46, up through the oil droplet input tube pipe **36*a*–36*e* in which droplets drip from an exit port 36*f* of the oil input tube 36. Brackets 48 and 50 secured to the chamber 24 support the air wand-diffuser plate-pipe 40–44. Horizontal support bar 52 supports the tube 36 in the chamber 24. Rear hole 54 in the chamber 24 provides venting. Vaporizer pan 56 is supported by metal fins 58*a*–58*e* of differential heights. Holes 22*a*–22*i* and likewise opposing holes not illustrated in the figure provide ventilation through the heat diffuser 22**.

FIG. 3 illustrates an enlarged perspective view of the combustion air wand 40 including the pipe 42 and the diffuser plate 44. The pipe 42 supports the wand 40 and couples air which is preheated in the pipe by the surrounding flame area from the air blower 18 to a closed annular channel 60 of the air wand 40 as illustrated in FIG. 4 for centering air about the burn area. A small number of holes 62 in the upper portion of the air wand 40 and a large number of holes 64 in the lower portion of the air wand 40 allow air to escape to the chamber 24 for combustion as also illustrated in FIG. 4. A plurality of holes 66 in the diffuser plate 44 allows air to mix with gas and form a burning mixture of vapors.

FIG. 4 illustrates a sectional view taken along line 4—4 of FIG. 3 where all numerals correspond to those elements previously described. Attention is noted to the small and large number of holes 62 and 64 respectively.

PREFERRED MODE OF OPERATION

The waste oil heater 10 is centrally located in a room, connected to a vent pipe having a barometric damper, the thermostat 19 is mounted on a wall, and the power plug 17 is connected to a source of AC power.

A small amount of fuel such as diesel No. 1 or No. 2 is placed in the vaporizer pan 56 and ignited with a wad of lighted paper through the door 26. The on-off switch is placed in an on position thereby starting the combustion air blower 18. As the chamber becomes hotter, a heat sensing disc 68 adjacent chamber 24 senses a predetermined temperature for ignition of waste oil thereby electrically starting the oil pump 20 through electromechanical control circuitry 70 as illustrated in FIGS. 1 and 2.

The pump 20 can be electrically stoked for different heat producing cycles such as low and high, by way of example. The thermostat 19 controls the heat level according to the demand of the building. The pump 20 assures an even flow of oil droplets in the combustion chamber 24 above wand 40 through the tube 36. Waste fuel can range from light transmission fluid to 90-weight motor oil.

The principle of operation is dependent on the vaporization of the oil through the vaporizer pan 56 which consistently boils the oil resulting in vapors arising up through the chamber 24 mixing with air from the wand 40, and interacting with air through the holes 66 in the diffuser plate 44.

The wand 40 and the pipe 42 also allow for preheating of the air prior to introduction into the chamber 24 through the holes 62 and 64 providing for a ring of fire. The diffuser plate 44 with the holes 66 also slows the rise of burning gases thereby increasing heat output and mixes the gases with air providing for total burn of the vapors. Also, the air wand 40 introduces air into the center of the combustion chamber 24 below the end **36*f* of the oil input tube 36**. Placement of the air wand with its incoming source of combustion air confines the flame area predominantly to that area surrounding the air wand.

Various modifications of the present invention are within the apparent scope thereof. The combustion air wand and diffuser can be used in other types of furnaces as the principle of operation is not limited to the combustion chamber of the present invention.

Having thus described the invention, what is claimed is:

1. Waste oil heater for burning of waste oil comprising:

a. combustion chamber means including chamber access and vent access;

b. fuel introducing means in an upper center portion of said chamber means and connected to a pump source of fuel; and c. combustion air introducing and mixing means including a closed annular channel suspended in the combustion chamber means below the fuel introducing means with air holes in inner and outer surfaces of the channel, said annular channel connected to an air blower whereby said fuel introducing means drops droplets of fuel into said combustion air introducing and mixing means for combustion of fuel and resultant vapors of mixed air and gases in the area surrounding the combustion air introducing and mixing means thereby providing for maximum heat output.

2. Heater of claim 1 comprising a heat deflector positioned on a bottom of said chamber means.

3. Heater of claim 1 comprising a vaporizer pan supported by metal fins above a bottom of said chamber means and below the combustion air introducing and mixing means thereby providing a means for vaporizing fuel for mixing with air introduced by the combustion air introducing and mixing means.

4. Heater of claim 1 wherein said combustion air introducing and mixing means includes a closed annular channel including a a plurality of a small number of holes in an upper portion of said annular channel, a large number of holes in a lower portion of said annular channel, and a pipe connecting said annular channel to said blower whereby said upper and lower holes provide combustion air below said fuel introducing means.

5. Heater of claim 1 wherein said combustion air introducing and mixing means of claim 1 or 4 include a horizontal diffuser plate having a plurality of spaced holes, said diffuser plate affixed to the combustion air introducing and mixing means between the upper and lower air introduction holes whereby the diffuser plate holes diffuse, hold down, spread, and mix air with gases forming a burning mixture of vapors.

6. Heater of claim 4 wherein the pipe extends from the combustion air introducing and mixing means through a portion of the interior of the combustion chamber and to an external source of air whereby the air is preheated by heat generated in the combustion chamber as the air travels through that portion of the pipe which extends through the interior of the combustion chamber.

7. Heater of claim 1 comprising a wall thermostat connected between a source of power and said pump and blower.

8. Oil heater for burning of petroleum fuel comprising:

a. combustion chamber means including a lower portion front access, a top portion access, and an upper portion rear vent;

b. air introducing means including a closed annular channel having a plurality of spaced holes in the inner and outer surfaces of the closed channel whereby combustion air flows in all directions, located in a mid portion of said chamber means and connected to an air blower;

c. fuel droplet tube introducing means supported in an upper portion of said chamber means and connected to a source of fuel through a pump whereby fuel droplets fall from the tube through the closed annular channel where combustion of a portion of the droplets occurs, those droplets not burning at that point continuing their fall through the channel to a vaporizer pan means; and d. vaporizer pan means located in a lower portion of said chamber means whereby said vaporizer pan means vaporizes excess oil droplets for subsequent burning in the mid portion of the chamber means thereby providing for maximum BTU output.

9. Waste Oil heater for burning petroleum oil comprising a storage tank including a filler opening, a heat deflector supported on top of said tank, a combustion chamber supported on said heat deflector, a spaced meshed safety screen surrounding the combustion chamber and affixed to the combustion chamber, a combustion air wand having a closed annular channel, the channel being centrally supported in the combustion chamber, the channel including a small and large number of air holes vertically spaced from each other in inner and outer surfaces of the channel for providing combustion air, a diffuser plate including a plurality of holes horizontally spaced from each other, the diffuser plate being circumferentially affixed between the small and large number of holes of said closed annular channel for mixing air with gases forming a resultant vapor which burns, a pipe supporting said air wand-diffuser and connected between said closed annular channel, through said combustion chamber and to a blower supported outside of said combustion chamber, an oil output tube having one end positioned through said combustion chamber adjacent to said center of the closed annular channel and another end connected to a submersible pump in said storage tank, a vaporizer slightly above the heat deflector and affixed to the heat deflector in said combustion chamber, a cam-locked access door in a lower front portion of said combustion chamber for providing access to said vaporizer pan, a vent hole in an upper rear portion of said combustion chamber, a removable top cover in a top of said combustion chamber, and an electrical wall thermostat connected between said pump and blower and a power source whereby said oil pump drops oil into said center of said air wand which has a stream of moving air flowing through the plurality of holes in said closed annular channel after being preheated in said pipe, and the vaporizer pan providing for initial combustion and subsequent boiling of excess petroleum thereby generating maximum BTU from said petroleum.

* * * * *